United States Patent [19]

Kelly

[11] 4,273,592

[45] Jun. 16, 1981

[54] COATING SOLUTION FOR METAL SURFACES

[75] Inventor: Timm L. Kelly, Oreland, Pa.

[73] Assignee: Amchem Products, Inc., Ambler, Pa.

[21] Appl. No.: 107,017

[22] Filed: Dec. 26, 1979

[51] Int. Cl.[3] ..... C23F 7/06

[52] U.S. Cl. ..... 148/6.27; 148/6.14 R; 148/31.5

[58] Field of Search ..... 148/6.27, 31.5, 6.14 R

[56] References Cited

U.S. PATENT DOCUMENTS

| | | | |
|---|---|---|---|
| 1,710,743 | 4/1929 | Pacz | 148/6.27 |
| 2,825,697 | 3/1958 | Carroll et al. | 148/6.27 |
| 3,160,506 | 12/1964 | O'Connor et al. | 148/6.2 |
| 3,682,713 | 8/1972 | Ries et al. | 148/6.27 |
| 3,912,548 | 10/1975 | Faigen | 148/6.27 |
| 3,964,936 | 6/1976 | Das | 148/6.27 |
| 4,148,670 | 4/1979 | Kelley | 148/6.15 R |

FOREIGN PATENT DOCUMENTS

| | | | |
|---|---|---|---|
| 2715292 | 10/1977 | Fed. Rep. of Germany | 148/6.15 |
| 2014617 | 8/1979 | United Kingdom | 148/6.27 |

*Primary Examiner*—Ralph S. Kendall
*Attorney, Agent, or Firm*—Alexis Barron

[57] ABSTRACT

An acidic aqueous coating solution for forming a coating on an aluminum surface which is corrosion resistant and to which overlying coatings adhere excellently. The coating solution contains a zirconium and/or hafnium compound, a fluoride compound, and a polyhydroxy compound having no more than 7 carbon atoms. The coating solution is capable of forming on an aluminum surface a uniformly colorless and clear coating so that the coated surface has the appearance of the underlying metal surface, that is, the coating can be formed without changing the appearance of the metal surface. When coating a bright shiny aluminum surface, there can be produced a coated surface having a uniformly bright shiny appearance which is maintained even after the coated surface is subjected to boiling water. Such surface is capable of undergoing the "muffle test" to confirm the presence of the clear and colorless coating.

64 Claims, No Drawings

COATING SOLUTION FOR METAL SURFACES

FIELD OF THE INVENTION

This invention relates to the application of coatings to aluminum surfaces which are corrosion resistant and to which overlying coatings, such as those formed from paints, inks and lacquers, adhere excellently. More particularly, this invention relates to aqueous coating solutions which form on aluminum surfaces the aforementioned types of coatings and do not require the presence of toxic materials, such as chromates and ferricyanide, for their effectiveness.

It is known to coat aluminum surfaces with aqueous coatings solutions that are effective in forming thereon coatings which are corrosion resistant and thereby protect the surface from degradation due to attack by corrosive materials. In general, the coatings formed from such coatings solutions should also have properties such that overlying coatings which are applied thereto adhere tightly and strongly. Such overlying coatings are decorative or functional in nature and are formed from materials such as paints, lacquers, inks, etc. (hereinafter referred to as "siccative coatings").

An example of an aluminum coating operation, and one in which the present invention has particularly good applicability, is the coating of aluminum cans. In general, the corrosion resistant and adherent coatings which are applied to aluminum cans should also be uniformly clear and colorless so that the coated cans have the bright shiny natural appearance of the underlying aluminum. This bright shiny natural appearance is desired in the final product even though portions of the can may be covered with colored paints or inks. (It is noted that there are other aluminum coating operations in which it is desired that the corrosion resistant and adherent coating imparts to the aluminum surface a colored appearance, for example a yellowish to green tint. However, this is not generally desired when coating aluminum cans.)

Another specific property that coated aluminum cans should have is the ability to resist discoloration when the coated can is subjected to moderately hot water, for example, water having a temperature within the range of about 140° F. to about 170° F. By way of background, it is noted that in certain applications, aluminum cans are so treated. (The can industry generally refers to this process as "pastuerization" of the cans.) This treatment has a tendency to cause an uncoated or even a coated aluminum surface to blacken or otherwise discolor, thereby leaving the can with an unattractive appearance. In general, when the term "corrosion resistance" is used in the industry in connection with coatings for aluminum cans, it includes within its meaning that the coated surface resists blackening or other discoloration when subjected to pastuerization. The term "corrosion resistance" is so used herein unless otherwise specifically stated.

A further property that is desirable in coated aluminum cans is the ability of such cans to undergo a simple test to confirm the presence of such coating. This property allows can manufacturers to randomly sample cans from their line and by means of such test determine that the clear and colorless coating is actually present on the cans. One such test conventionally employed in can industry is known as the "muffle test".

There are available presently coating solutions which form on aluminum surfaces uniformly clear colorless coatings. One of the most widely used coating solutions, which forms such coatings, contains chromic acid, phosphoric acid and hydrofluoric acid. While such a coating solution is capable of forming coatings of the type desired, their use creates waste disposal problems because of the presence therein of hexavalent chromium, a very toxic material. It would be of great advantage to users of such coating solutions to have available coating solutions which do not contain hexavalent chromium.

This invention relates to the provision of an aqueous coating solution which does not require the use of hexavalent chromium or similarly toxic materials, and which is capable of forming a clear and colorless, corrosion resistant coating on an aluminum surface which resists blackening or other discoloration even after being subjected to boiling water and which is also capable of undergoing the "muffle test" to confirm its presence on the surface, and to which overlying coatings adhere well.

REPORTED DEVELOPMENTS

There has been developed a number of types of aluminum coatings solutions. Some of these coating solutions are reported to form colored coatings on aluminum surfaces. Other of the coating solutions require the application of toxic materials, such as chromates and ferricyanide, for their effectiveness.

For example, U.S. Pat. No. 1,638,273 discloses aqueous coating solutions containing a soluble fluosilicate, a salt of a non-ferrous, iron-group metal and an alkali salt. The patent reports that the coatings formed from such coating solutions are mottled, speckeled or spotted in appearance. U.S. Pat. No. 1,710,743 discloses aqueous solutions for treating aluminum and aluminum alloys containing double metal fluoride compounds such as sodium zirconium fluoride, sodium titanium fluoride, potassium zirconium fluoride and potassium titanium fluoride. The coatings formed from such solutions are said to be of varying color (for example, grey, yellowish, golden, reddish and black), depending on the particular aluminum alloy being coated, the particular ingredients and amounts thereof comprising the solution, and the duration of the treatment. U.S. Pat. No. 2,276,353 discloses aqueous coating solutions containing hydrofluosilic acid or salts thereof, an oxidizing agent and optionally an accelerating agent such as nitrate. The patent discloses the formation on aluminum surfaces of coatings which are grey, brown, white or reddish purple, depending on the specific ingredients and amounts thereof comprising the solution. In U.S. Pat. No. 3,610,506, there is disclosed an aqueous coating solution containing a transition metal fluoride which is said to be effective in forming coatings on aluminum printing plates which are stable under relatively high humidity and temperature conditions. There is no disclosure in this patent concerning the color of the coatings formed or the degree of corrosion resistance imparted by the coatings to the aluminum surface. It is noted that this patent discloses that the treated surface is sealed by contacting it with a chromic acid solution. U.S. Pat. No. 3,682,713 discloses an acidic aqueous coating solution containing a complex fluoride (such as fluorides of boron, titanium, zirconium or iron), free fluoride ions, and an oxidizing agent such as sodium nitrobenzene sulfonate or nitrate. The patent also discloses that the coatings formed on aluminum are subjected to after-treatment with chromic acid and/or phosphoric acid or their salts. U.S. Pat. No. 3,066,055 discloses coating solutions which are said to form colorless coatings on aluminum surfaces. The coating solutions contain fluoride compounds (including simple fluorides, complex fluorides, or double metal fluorides), along with hexavalent chromium, ferricyanide, molybdate or tungstate, and also a cation selected from elements 23 to 29 of the Periodic Table. It can be seen that the coating solution described in this patent contains various types of materials which create waste disposal problems. See also U.S. Pat. No. 2,825,697 which discloses an aqueous coating solution which forms coatings on an aluminum surface which are said to be substantially colorless. The coating composition described in this patent is an aqueous solution containing hexavalent chromium and a complex fluorine-bearing compound such as fluosilicic acid, fluoboric acid, fluozirconic acid, fluostannic acid, fluotitanic acid or soluble salts thereof.

In the overall picture, the prior art discloses aqueous coating solutions which require the application of toxic materials, such as chromates and ferricyanide, for their effectiveness, or they disclose coating solutions which are said to form colored coatings on aluminum surfaces. Two possible exceptions are U.S. Pat. Nos. 3,964,936 and 4,148,670. U.S. Pat. No. 3,964,936 discloses an acidic aqueous coating solution containing compounds of zirconium and fluorine, and optionally, a water soluble boron compound. Such solution is said to be capable of forming a uniformly colorless and clear coating on aluminum surfaces to which overlying siccative coatings adhere well. However, such coatings do not appear to be capable of undergoing a simple test to confirm its presence on the surface. The reason for this is the absence of phosphate in the coating which was heretofore believed necessary for a coating to undergo such test. Furthermore, boron, when present in the coating solution, can create certain waste disposal problems. U.S. Pat. No. 4,148,670 discloses an acidic aqueous coating solution containing compounds of zirconium and/or titanium, fluorine, phosphate, and optionally, a polyhydroxy compound having 6 or fewer carbon atoms. Such solution is said to be capable of forming a uniformly colorless and clear coating on aluminum surfaces. The presence of phosphate in the solution was said to contribute to the corrosion resistance and adherent properties of the coating, and to allow the coating to undergo the so-called "muffle test" which confirmed its presence on the aluminum surface. However, such phosphate has been found to cause a decrease in the adhesion of certain water-borne siccative coatings, and it would be desirable to produce a coating containing no phosphate.

Accordingly, it is an object of the present invention to provide an aqueous coating solution which is phosphate-free and boron-free and does not require the use of hexavalent chromium or similarly toxic materials, and which is capable of forming a uniformly clear and colorless, corrosion resistant coating on an aluminum surface which resists blackening or other discoloration even after being subjected to boiling water and which is also capable of undergoing the "muffle test" to confirm its presence on the surface, and to which overlying coatings adhere well.

BRIEF DESCRIPTION OF THE INVENTION

In accordance with this invention, there is provided an aqueous treatment or coating solution which contains as essential ingredients a zirconium and/or hafnium compound, a fluoride compound, and a polyhydroxy compound having no more than 7 carbon atoms. Such solution can be used to treat a bright shiny aluminum surface in a manner such that the bright shiny appearance of the surface is not changed, while forming on the surface a uniformly colorless and clear coating which is corrosion resistant and to which overlying coatings adhere excellently. A surface treated in this manner is capable of undergoing the so-called "muffle test" to confirm the presence of the clear and colorless coating.

The corrosion resistant properties of coatings formed from coating solutions within the scope of the present invention include the ability of such coatings to withstand blackening or other discoloration when subjected to hot water having a temperature within the range of about 140° F. to about 170° F. for a period of time of at least about 5 minutes up to as long as 15 minutes.

The coating solution of the present invention is capable of effectively forming the aforementioned type of coatings on an aluminum surface in the absence of toxic materials and materials of the type which create waste disposal problems, including, for example, hexavalent chromium and elements such as boron, manganese, iron, cobalt, nickel, molybdenum and tungsten, and also materials such as ferricyanide and ferrocyanide. Accordingly, it is not necessary, to add to the coating solution of the present invention materials, which if added, would mandate that effluents comprising the solution be treated specially before the effluent is discharged to the environment or to a sewage disposal plant.

As will be explained in detail below, another aspect of the present invention relates to the use of a replenishing composition for maintaining the effective operation of a coating bath as it is used continuously to coat aluminum articles.

DETAILED DESCRIPTION OF THE INVENTION

The coating solution of the present invention can be used to coat surfaces of pure aluminum or alloys of aluminum, for example, aluminum alloys containing minor amounts of metals such as, for example, magnesium, manganese, copper and silicon. Presently, the most popular alloy used in the aluminum can industry is aluminum alloy 3004. It is believed that one of the widest uses of the coating solution of the present invention will be the coating of aluminum surfaces which have a bright shiny appearance. Aluminum cans and aluminum strip are examples of articles that can be treated effectively with the composition of this invention.

The acidic aqueous coating solution can be prepared from a variety of compounds which contain the aforementioned essential ingredients (a zirconium and/or hafnium compound, a fluoride compound, and a polyhydroxy compound having no more than 7 carbon atoms) and which are soluble in the solution. As to the source of the zirconium and/or hafnium and fluoride, there can be used soluble fluozirconate and/or fluohafnate compounds such as, for example, fluozirconic and fluohafnic acids, as well as ammonium and alkali metal fluozirconates and fluohafnates. The coating solution can also be prepared from metallic fluorides such as zirconium fluoride ($ZrF_4$) and/or hafnium fluoride ($HfF_4$). In addition, the coating solutions can be prepared from a mixture of soluble compounds, one of which contains zirconium or hafnium, and the other of which contains fluoride. Examples of such compounds are zirconium nitrate, zirconium sulfate, hafnium nitrate, and hydrofluoric acid and water soluble salts thereof, for example, ammonium and alkali metal salts.

Any water soluble polyhydroxy compound having no more than 7 carbon atoms can be employed in the coating solution, as well as any compound which forms such polyhydroxy compound when dissolved in water. Suitable compounds include gluconic acid, salts of gluconic acid, sorbitol, mannitol, dextrose, ethylene glycol, glycerine and sodium alpha-glucoheptonate.

Particularly preferred polyhydroxy compounds are gluconic acid and alkali metal and ammonium salts of gluconic acid. Any compound which yields gluconic acid or such gluconic acid salts when dissolved in water may also be used. Examples of such compounds are stable glucono-lactones such as glucono-delta-lactone and glucono-gamma-lactone.

Developmental work has shown that zirconium and/or hafnium must be present in the coating, that is, they must be directly or indirectly bonded to the aluminum surface in order to achieve coatings having satisfactory properties. Satisfactory coatings can be formed from coating solutions containing as little as about $0.5\times10^{-3}$ moles/liter of zirconium and/or hafnium (0.046 g/L of Zr; 0.090 g/L of Hf). (When utilizing a mixture of zirconium and hafnium, the total of the amounts of zirconium and hafnium should be at least $0.5\times10^{-3}$ moles/liter.) However, as will be explained below, greater amounts of these ingredients may be required to produce satisfactory coatings depending on other parameters of the coating process.

Zirconium and/or hafnium can be used in amounts up to their solubility limits in the acidic aqueous coating solution. The solubility limits of the ingredients will depend on other parameters of the coating solution, including particularly, the acidity of the coating solution and the amount of fluoride in the coating solution. These parameters should be controlled so that the formation of zirconium and hafnium oxide precipitate is avoided. The formation of such precipitate is undesirable for several reasons. Precipitation depletes the amount of the ingredients. Also, the deposition on the coated aluminum surface of precipitate can adversely effect the coating properties. In addition, the formation and accumulation of any type of precipitate can tend to interfere with the application of the coating solution. For example, it can clog spray nozzles. If precipitation is encountered in a specific application, the pH of the coating solution should be lowered, and/or the amount of fluoride can be increased.

As to the polyhydroxy ingredient, it has been found that the use of polyhydroxy in the coating solution allows the user to conduct a simple test to confirm the presence of the coating on the alumunum surface. In an industrial operation which can involve the treatment of vast quantities of aluminum in a relatively short time, it is helpful to have a simple test to confirm that the coating solution is forming a coating since the coating is not visible to the eye. (An unnoticed change in the operating parameters of a bath of the coating solution which renders it ineffective may take place as a result of mechanical or human failure. For example, improper replenishment of the coating solution may go unnoticed.) It has been found that an aluminum surface coated with the composition of the present invention changes in color varying from light golden brown to darker shades of brown or purple when subjected to a relatively high temperature for a relatively short period of time, for example, 900° F. for 5 minutes. This test, referred to herein as the "muffle test", can be used to randomly sample treated aluminum surfaces to determine whether or not the coating solution is depositing on the aluminum surface. If the coating is not being deposited, the aluminum surface has a dull greyish appearance after the muffle test. The ability of such surfaces to successfully undergo this test is quite surprising as heretofore it has been believed that the presence of phosphate was necessary to obtain a positive test.

Another advantage derived from the polyhydroxy compound is that it enchances the ability of coatings formed from coating solutions containing this ingredient to withstand blackening or other discoloration for a period of at least 5 minutes up to as long as 15 minutes when subjected to water having a temperature within the range of about 140° F. to about 170° F. As noted above, aluminum cans are sometimes treated in this manner when subjected to so-called "pasteurization" procedures.

It has been found also that the use of polyhydroxy contributes to the corrosion resistance and adherent properties of the coatings, particularly coatings formed from a coating solution having a pH below about 3.5. In addition, it has been found that overlying siccative coatings, particularly water-borne coatings, adhere very well to coatings which contain polyhydroxy compounds. While organic-borne siccative coatings adhere well to coatings containing phosphates, certain water-borne coatings have not been found to adhere nearly as well to such coatings.

Coated aluminum cans having a high level of water stain resistance and capable of discoloring when subjected to the aforementioned muffle test have been produced from coating compositions containing as little as about $0.025\times10^{-5}$ moles/liter of polyhydroxy compound. Preferably, such coating compositions contain from about $0.3\times10^{-3}$ moles/liter to about $1.75\times10^{-3}$ moles/liter of polyhydroxy compound. Amounts in excess of about $2.0\times10^{-3}$ moles/liter do not bring about any added improvement in result and are usually unnecessary. Indeed, at higher levels of concentration, the improvements derived from the use of the polyhydroxy compound begin to diminish, and at a concentration of about $2.5\times10^{-3}$ moles/liter the polyhydroxy compound begins to adversely effect water stain resistance.

As to the fluoride concentration, the minimum concentration should be that which is sufficient to combine with all of the zirconium or hafnium to form a soluble complex therewith, for example a fluozirconate or fluohafnate. Accordingly, the minimum amount of fluoride is dependent on the amount of zirconium or hafnium in the solution. In general, at least about four moles of fluoride per mole of zirconium or hafnium is necessary to prevent precipitation of such metals. Preferably, at least about six moles of fluoride are employed per mole of zirconium or hafnium.

Other considerations respecting the minimum fluoride concentration should be taken into account in any application in which a coating solution which has been contacted with aluminum is reused for contact with additional aluminum. By way of explanation, it is noted that the coating solution of the present invention dissolves aluminum. Thus, in an application in which the aluminum is contacted with the coating solution by immersing it in a bath of the coating solution, there is a build-up in concentration of dissolved aluminum in the bath. Similarly, if spraying or flow coating techniques are used for contacting the aluminum, and excess or unreacted solution is recycled to the bath of solution, there is a build-up of dissolved aluminum in the bath. In order to deter or prevent adverse effects on the coating process as a result of a build-up of aluminum in the coating solution, the coating solution should contain sufficient amount of fluoride to complex the dissolved aluminum . This is important for the satisfactory operation of a continuous coating process. The amount of fluoride needed will depend on the extent to which aluminum builds up in the coating solution. And this in turn depends on various factors such as the shape of the aluminum surface being treated and the manner in which the surface is contacted with the solution.

Any material which is soluble in the coating solution and which is a source of fluoride capable of complexing aluminum and which does not contain a constituent which adversely affects the coating process can be used. However, if fluoride is added as a complex fluoride of zirconium or hafnium, there should also be added to the solution another material which is a source of fluoride for complexing aluminum which builds-up as the process is continued. The amount of fluoride available from hydrolysis of such complex fluoride may not be sufficient to complex the aluminum, and the extent of hydrolysis may be such that uncomplexed zirconium or hafnium will precipitate an undesirable oxide precipitate. By utilizing another material which will readily provide sufficient fluoride for complexing the aluminum, the aforementioned is avoided. Examples of such materials are hydrofluoric acid, salts thereof, $NH_4F.HF$ and alkali metal bifluorides. Hydrofluoric acid is a particularly good source of fluoride because it provides sufficient fluoride to complex the aluminum and is not a source of extraneous cations which may interfere with the coating process.

From a practical standpoint, the coating solution should contain, when operating on an industrial scale, an excess of fluoride, that is, an amount above that complexed with aluminum and any other metal constituents in the solution that form complexes with the fluoride. Such excess fluoride is referred to herein as "available fluoride" and includes fluoride present as HF and fluoride ion, that is, F not associated with any metal present in the solution. The available fluoride concentration is that found when a sample of the coating solution, diluted with a constant ionic strength buffer which contains 40.8 g/L of sodium acetate, 28.5 ml/L of glacial acetic acid and 58.0 g/L of sodium chloride is deionized water and adjusted to a pH within the range of 5.0 to 5.3 with NaOH, is tested with an Orion pH meter (model No. 9409) having an Orion fluoride ion specific electrode (model No. 90-01). A coating solution which contains available fluoride is one in which fluoride is available to complex with aluminum.

The upper concentration of available fluoride is that which does not result in undue etching of the aluminum surface. Undue etching tends to produce a dull and frostly surface. It has also been observed that the presence of an excess of available fluoride can adversely affect the corrosion resistant and adherent properties of the coating, and may cause precipitation of calcium or other metal ions which may be present in the coating solution. (Such metal ions are preferably introduced into the coating solution when hard water is employed in preparing the composition.) The available fluoride concentration which leads to such problems can vary depending on other parameters of the coating process, including, for example, the pH of the solution and time and temperature of contact. It is recommended that the available fluoride concentration be no greater than about $26.3\times10^{-3}$ moles/liter.

The pH of the coating solution should be within the range of about 3.0 to about 5.0. At higher pHs precipitation of metal oxides can be a problem. Preferably, a pH within the range of about 3.0 to about 4.0 is used. The pH of the solution may be adjusted by using appropriate amounts of nitric acid or ammonium hydroxide. Although nitric acid and ammonium hydroxide are recommended as pH adjusters, any acid or base which will not interfere with the coating process can be used. For example, perchloric acid or sulfuric acid can be used.

The coating solution should be free of chromium and other materials such as iron cyanides and any materials which form in the solution solids which tend to precipitate.

A particularly preferred coating solution for use in the practice of this invention has a pH within the range of about 3.4 to about 4.0 and contains:

| Ingredient | Approximate Concentration in Moles/Liter |
|---|---|
| Zr | $0.50\times10^{-3}$ to $1.75\times10^{-3}$ |
| Polyhydroxy Compound | $0.30\times10^{-3}$ to $1.75\times10^{-3}$ |
| Available Fluoride | $0.50\times10^{-3}$ to $2.50\times10^{-3}$ |

The preferred source of Zr in the above composition is ammonium fluozirconate, and the preferred polyhydroxy compound is gluconic acid. Preferably hydrofluoric acid is used as the source of available fluoride, and nitric acid is used to adjust the pH.

When utilizing hafnium, it is preferably used in an amount of from about $0.5\times10^{-3}$ moles/liter to about $1.75\times10^{-3}$ moles/liter. The preferred source of hafnium is $HfF_4$. Other of the preferred ingredients and amounts thereof are described immediately above for the preferred Zr-containing solution.

Amount ranges for ingredients comprising the composition have been described above. Considerations should be taken into account in formulating specific compositions for specific applications while working within the aforementioned ranges. When operating at a relatively high pH, relatively small amounts of zirconium and/or hafnium should be used to deter precipitation. When contacting the coating solution and the aluminum surface for a relatively short time relatively high amounts of zirconium and/or hafnium should be used. Similarly, when the temperature of contact between the coating solution and the aluminum surface is relatively low, relatively high amounts of ingredients should be used.

The coating solution of the present invention can be prepared conveniently by diluting an aqueous concentrate of the ingredients with an appropriate amount of water. The concentrate should be such that when a coating solution contains about 0.5 to about 10 weight percent of the concentrate, the amounts of ingredients present in th coating solution are: (A) at least about $0.5\times10^{-3}$ moles/liter of zirconium and/or hafnium; (B) at least about $0.025\times10^{-3}$ moles/liter of polyhydroxy compound, and (C) fluoride in an amount at least sufficient to combine with substantially all of the zirconium or hafnium to form a complex therewith; and the pH of the coating solution is within the range of about 3.0 to about 5.0.

A concentrate for preparing a preferred coating solution for use in the invention is such that when the coating solution comprises about 0.5 to about 10 weight percent of the concentrate, the coating solution comprises: (A) about $0.5\times10^{-3}$ moles/liter to about $1.75\times10^{-3}$ moles/liter of zirconium, added as a fluozirconate such as sodium or potassium fluozirconate, most preferably ammonium fluozirconate; (B) about $0.3\times10^{-3}$ moles/liter to about $1.75\times10^{-3}$ moles/liter of polyhydroxy compound added as gluconic acid; (D) about $0.5\times10^{-3}$ moles/liter to about $2.50\times10^{-3}$ moles/liter of HF; and (E) nitric acid in an amount such that the pH of the coating solution is within the range of about 3.4 to about 4.0.

In a continuous coating operation, it is important to properly replenish the solution in order to maintain the effectiveness of the coating process. Work done in connection with the development of the present invention has shown that various of the ingredients comprising the solution are depleted as a result of reactions which occur during the formation of the coating. Thus, for example, both the zirconium and/or hafnium and the polyhydroxy have been found to be present in the coating and are depleted quite rapidly. Available fluoride is consumed as a result of complexing with aluminum, and hydrogen is consumed as the aluminum surface is oxidized. In addition, ingredients are depleted as a result of dragout of the solution on the aluminum surface. Work has also shown that the rate of depletion of ingredients is related to the shape of the surface being coated and the manner in which the coating solution is contacted with the aluminum surface. For example, when spraying cans, there is a greater drag-out loss than when spraying strip.

The coating solution can be replenished as the ingredients are depleted. This may be accomplished by either monitoring the amount of each ingredient in the coating solution and adding this ingredient as it is depleted or it can be accomplished by adding thereto an aqueous concentrate of the ingredients.

The replenishing ingredients should be added to the solution to maintain the ingredients thereof in effective operating amounts. In an application in which there is a build-up of aluminum in the coating solution, it is recommended that the replenishing composition contain a relatively high proportion of fluoride for complexing the aluminum. Preferred sources of available fluoride are HF or ammonium bifluoride or a mixture thereof. The following is a recommended aqueous concentrate for replenishing the coating solution.

(A) about $30.8\times10^{-3}$ moles/liter to about $250.5\times10^{-3}$ moles/liter of zirconium and/or hafnium;

(B) about $18.9\times10^{-3}$ moles/liter to about $148.0\times10^{-3}$ moles/liter of polyhydroxy compound; and (C) a material which is a source of about $89.5\times10^{-3}$ moles/liter to about $695.0\times10^{-3}$ moles/liter of available fluoride, preferably HF or ammonium bifluoride of a mixture thereof.

The coating solution should be applied to a clean aluminum surface. Available cleaning compositions such as alkaline or acid cleaning solutions can be used to clean the aluminum surface according to conventional techniques.

The coating solution can be applied to the aluminum surface by any suitable method. For example, the solution can be applied by spraying the aluminum surface, or the aluminum surface can be immersed in the solution, or it can be applied by roll or flow coating techniques or misting techniques. It is believed that the solution can be applicated very economically by spraying. The solution can be used to coat individual articles such as, for example, cans, or it can be used to coat forms of aluminum, such as aluminum strip, which are subsequently fabricated into articles.

The temperature of the coating solution should be such that the reactive ingredients of the solution bond to the aluminum surface. In general, a temperature of at least about 100° F. is required to produce the desired degree of water stain resistance. Preferably, the coating solution should have a temperature of about 130° F. to about 150° F. If the temperature of the coating solution is too high, a dull and frosty appearing surface can be obtained. The temperature at which this occurs depends on various of the parameters of the coating operation, including, for example, the time of contact of the solution with the aluminum surface and the reactivity of the solution which depends on pH and concentration of ingredients in the solution. Furthermore, at temperatures in excess of about 160° F., precipitation of zirconium and/or hafnium oxides may become a problem if the pH of the coating solution rises above about 4.5.

Desired coatings can be formed by contacting the coating solution and the aluminum surface for at least about 5 seconds, preferably at least about 15 seconds. The lower the temperature of the coating solution, the longer should be the contact time, and the higher the temperature of the solution, the shorter the contact time required. In general, it will be unnecessary to contact the surface with the coating solution for more than one minute.

The acidic aqueous coating solution is capable of forming a very thin and very light weight coating. The coating weight will vary depending upon the concentration of the various ingredients in the coating solution, the temperature of application, and the time of application. For uses of the type referred to herein, it is preferred that the coating have a weight of about 2 to about 20 mg/sq. ft., preferably about 5 to about 10 mg/sq. ft. Coatings having such weights can be formed by operating within the conditions described above. Higher coating weights can create problems in the aluminum can coating industry. The machinery which applies paint or ink to coated aluminum cans has precise tolerances to accommodate cans having very thin coatings. Cans with relatively thick coatings can foul the machinery.

Utilizing the coating solution of the present invention, it is possible to form coatings which are very uniform. This permits paint or ink to be applied evenly and with desired coverage to the coated aluminum surface. In the aluminum can industry, paint and ink coatings are applied to coated aluminum cans by an automatic roller coating machine in which paints and inks are applied to a roller and then to the surface of the coated can as the roller is rotated across the surface of the coated can. If the can has a non-uniform coating, the subsequently applied ink or paint composition may not cover the desired areas of the can.

After the coating solution has been applied to the aluminum surface, it should be water rinsed, including a final deionized water rinse. Rinsing with water that contains a small amount of dissolved solids may lead to a coating which has poor painting adhesive properties. In utilizing the present invention, it is not necessary to rinse the coated surface with an aqueous solution of chromium such as, for example, a hexavalent chromium solution.

After the coated surface has been water rinsed, or otherwise treated as described above, the coating should be dried. This can be done by any practical mens, such-as, for example, oven drying or forced circulation of hot air. Other available drying methods can be used.

After the coating has been applied, it can be subjected to sanitary or decorative coating operations which include, for example, applying to the coated surface siccative coatings. These coatings are usually applied after the aluminum surface has been coated, water-rinsed and dried. In some applications, the sanitary coating is applied after the water rinse and both the coating of the present invention and the sanitary coating are dried simultaneously.

By way of example, it is noted that in an application where aluminum cans are to be filled with beer, the cans are treated with the coating solution of the present invention and then sanitary and/or decorative coatings are applied. Thereafter, the cans are filled with beer and sealed, after which the beer-filled cans are subjected to pasteurization.

It is believed that the zirconium and/or hafnium present in the coating solutions of the present invention is present in a complexed form which is both soluble in the solution and reactive with the aluminum surface to form thereon a coating containing such metal without effecting the bright shiny appearance of the aluminum surface. Accordingly, the solution should be free of constituents which combine with zirconium and/or hafnium to form zirconium and/or hafnium-containing compounds and/or complexes which precipitate from the solution and/or zirconium and/or hafnium-containing compounds or complexes which are not reactive with the aluminum surface or which are reactive, but in a manner such that the bright shiny appearance of the aluminum surface is altered.

EXAMPLES

Examples below are illustrative of the practice of the present invention. Comparative examples are set forth also.

Unless stated otherwise, the aluminum surfaces treated with the solutions identified in the examples were drawn and ironed aluminum cans which were first degreased, as necessary, in an acidic aqueous cleaner containing sulfuric acid, fluoride and detergents. Unless stated otherwise, the coating solutions were applied by spraying for about 20 seconds at the temperatures set forth below. After treatment with the solutions identified in the examples, the aluminum surfaces were rinsed in deionized water and dried in an oven for 3.5 minutes at about 400° F.

Thereafter, the aluminum cans were tested for corrosion resistance by subjecting them to a water stain resistance test simulating can exposure during commercial pasteurization processes. The test consisted of immersing the cans for a period of 30 minutes in a hot solution of distilled or deionized water containing 0.220 g/L of sodium bicarbonate, 0.082 g/L of sodium chloride, and 2.180 g/L of a water conditioner (Dubois 915, a proprietary product, supplied by Dubois Chemical Inc., which exhibits a total alkalinity of 5.8% $Na_2O$ and on analysis contains $NaNO_3$, carbonate, triethanolamine and dodicylphenyl polyethylene glycol). The solution was maintained at 150±5° F. during the test. After immersion, the cans were rinsed with tap water, dried with a paper towel and then examined for staining. A cleaned-only aluminum surface, when subjected to this test, turns black or brown after a few minutes. It will be seen from examples set forth below that prior treatment of the aluminum surfaces with coating solutions of the present invention resulted in the provision of coated surfaces which were not blackened or otherwise discolored or which resisted blackening or other discoloration. The results of the tests were rated as follows: 5, perfect, no blackening; 3+, acceptable; and 0, total failure, severe blackening.

Aluminum cans treated with the solutions described in the examples were tested also for paint adhesion. After the treated surface was dried, as described above, a portion of the surface was painted with a waterborne white base coat (No. CE3179-2 white polyester sold by PPG Industries Inc.) and the other portion of the surface was painted with a waterborne overvarnish (Purair* S145-121 sold by Inmont Corp). After the paint was cured, the painted surface was immersed in boiling water for 15 minutes. After removing the painted surface from the solution, it was cross hatched, using a sharp metal object to expose lines of aluminum which showed through the paint or lacquer, and tested for paint adhesion. This test included applying Scotch** transparent tape No. 610 firmly over the cross hatched area and then drawing the tape back against itself with a rapid pulling motion such that the tape was pulled away from the cross hatched area. The results of the test were rated as follows: 10, perfect, when the tape did not peel any paint from the surface; 8, acceptable; and 0, total failure.

*"Purair" is a registered trademark.
**"Scotch" is a registered trademark of the 3M Co.

Table I below shows the effect of gluconic acid concentration on water stain resistance of coatings applied at varying temperatures from 90° F. to 150° F. Zirconium was present in each solution in the form of ammonium fluozirconate ($(NH_4)_2ZrF_6$) at a concentration of $1.25\times10^{-3}$ moles/liter, and each solution was adjusted to a pH of 3.8 by the addition of concentrated nitric acid. Two cans were empolyed in determining the water stain resistance rating of each solution.

TABLE 1

Effect of Gluconic Acid Concentration on Water Stain Resistance at $1.25\times10^{-3}$M $(NH_4)_2ZrF_6$ Concentration and pH of 3.8

| Sample No. | Gluconic Acid Conc. (M × $10^{-3}$) | Temp. (°F.) | Water Stain Resistance |
|---|---|---|---|
| 1 | 0 | 90 | 0,0 |
| 2 | 0 | 110 | 0,0 |
| 3 | 0 | 130 | 0.5,0.5 |
| 4 | 0 | 150 | 3,3 |
| 5 | 0.025 | 90 | 0,0 |
| 6 | 0.025 | 110 | 0.5,0.5 |
| 7 | 0.025 | 130 | 0.5,0.5 |
| 8 | 0.025 | 150 | 4,4 |
| 9 | 0.05 | 90 | 0,0 |
| 10 | 0.05 | 110 | 0.5,0.5 |
| 11 | 0.05 | 130 | 0.5,1 |
| 12 | 0.05 | 150 | 4,4 |
| 13 | 0.1 | 90 | 0.5,0.5 |
| 14 | 0.1 | 110 | 1,1 |
| 15 | 0.1 | 130 | 3,4 |
| 16 | 0.1 | 150 | 4,4 |
| 17 | 0.2 | 90 | 0.5,0.5 |
| 18 | 0.2 | 110 | 2,1 |
| 19 | 0.2 | 130 | 3.5,4 |
| 20 | 0.2 | 150 | 3.5,3.5 |
| 21 | 0.3 | 90 | 0.5,0.5 |
| 22 | 0.3 | 110 | 3.5,3.5 |
| 23 | 0.3 | 130 | 4,5 |

TABLE 1-continued

Effect of Gluconic Acid Concentration on Water Stain Resistance at $1.25 \times 10^{-3}$M $(NH_4)_2ZrF_6$ Concentration and pH of 3.8

| Sample No. | Gluconic Acid Conc. ($M \times 10^{-3}$) | Temp. (°F.) | Water Stain Resistance |
|---|---|---|---|
| 24 | 0.3 | 150 | 5,5 |
| 25 | 0.4 | 90 | 1,1 |
| 26 | 0.4 | 110 | 4,2 |
| 27 | 0.4 | 130 | 3,3 |
| 28 | 0.4 | 150 | 4,5 |
| 29 | 0.5 | 90 | 1,1 |
| 30 | 0.5 | 110 | 4,4 |
| 31 | 0.5 | 130 | 5,5 |
| 32 | 0.5 | 150 | 4,4 |
| 33 | 0.75 | 90 | 1,1 |
| 34 | 0.75 | 110 | 3.5,3.5 |
| 35 | 0.75 | 130 | 4,4 |
| 36 | 0.75 | 150 | 3.5,3.5 |
| 37 | 1.0 | 90 | 1,1 |
| 38 | 1.0 | 110 | 2,2 |
| 39 | 1.0 | 130 | 4,3 |
| 40 | 1.0 | 150 | 4,3.5 |
| 41 | 1.25 | 90 | 0,0 |
| 42 | 1.25 | 110 | 1,1 |
| 43 | 1.25 | 130 | 4,4 |
| 44 | 1.25 | 150 | 4,4 |
| 45 | 1.5 | 90 | 0,0 |
| 46 | 1.5 | 110 | 1,1 |
| 47 | 1.5 | 130 | 2.5,2 |
| 48 | 1.5 | 150 | 5,5 |
| 49 | 1.75 | 90 | 0,0 |
| 50 | 1.75 | 110 | 1,1 |
| 51 | 1.75 | 130 | 4,4 |
| 52 | 1.75 | 150 | 5,5 |
| 53 | 2.0 | 90 | 0,0 |
| 54 | 2.0 | 110 | 1,1 |
| 55 | 2.0 | 130 | 3,2 |
| 56 | 2.0 | 150 | 5,5 |
| 57 | 5.0 | 90 | 0,0 |
| 58 | 5.0 | 110 | 0,0 |
| 59 | 5.0 | 130 | 0,0 |
| 60 | 5.0 | 150 | 2,2 |

Table II below also shows the effect of gluconic acid concentration on water stain resistance, as well as on the adhesion of water-borne siccative coatings, at two different pH and temperature levels. Again zirconium was present in each solution in the form of ammonium fluozirconate ($(NH_4)_2ZrF_6$) at a concentration of $1.25 \times 10^{-3}$ moles/liter, and the pH of each solution was adjusted by the addition of concentrated nitric acid. Two cans were employed in determining the paint adhesion rating while the water stain resistance rating represents the average rating of six cans.

TABLE II

Effect of Gluconic Acid Concentration on Water Stain Resistance and Adhesion of Waterborne Siccative Coatings at $1.25 \times 10^{-3}$ M $(NH_4)_2ZrF_6$ Concentration

| Sample No. | Gluconic Acid Conc. ($M \times 10^{-3}$) | pH | Temp. (°F.) | Water Stain Resistance | Adhesion CE3179-2 | Adhesion S145-121 |
|---|---|---|---|---|---|---|
| 1 | 0 | 3.5 | 125 | 1 | 10,10 | 10,7 |
| 2 | 0 | 3.5 | 135 | 2 ⅜ | 10,10 | 10,8 |
| 3 | 0 | 4.25 | 125 | 4 | 10,10 | 10,10 |
| 4 | 0 | 4.25 | 135 | 2 ⅜ | 10,8 | 10,8 |
| 5 | 0.5 | 3.5 | 125 | 5 | 10,10 | 10,10 |
| 6 | 0.5 | 3.5 | 135 | 5 | 10,10 | 10,10 |
| 7 | 0.5 | 4.25 | 125 | 4 ⅜ | 10,10 | 10,10 |
| 8 | 0.5 | 4.25 | 135 | 4 ⅜ | 10,9 | 10,10 |
| 9 | 1.25 | 3.5 | 125 | 4 1/6 | 10,10 | 10,10 |
| 10 | 1.25 | 3.5 | 135 | 5 | 10,10 | 10,10 |
| 11 | 1.25 | 4.25 | 125 | 5 | 10,10 | 10,10 |
| 12 | 1.25 | 4.25 | 135 | 5 | 10,10 | 10,10 |
| 13 | 2.5 | 3.5 | 125 | 1 1/6 | 10,10 | 10,10 |
| 14 | 2.5 | 3.5 | 135 | 2 ⅜ | 10,8 | 10,10 |

TABLE II-continued

Effect of Gluconic Acid Concentration on Water Stain Resistance and Adhesion of Waterborne Siccative Coatings at $1.25 \times 10^{-3}$ M $(NH_4)_2ZrF_6$ Concentration

| Sample No. | Gluconic Acid Conc. ($M \times 10^{-3}$) | pH | Temp. (°F.) | Water Stain Resistance | Adhesion CE3179-2 | Adhesion S145-121 |
|---|---|---|---|---|---|---|
| 15 | 2.5 | 4.25 | 125 | 1 ⅜ | 10,10 | 10,10 |
| 16 | 2.5 | 4.25 | 135 | 4 ⅜ | 9,9 | 10,10 |

Table III below shows the effect of ammonium fluozirconate concentration on water stain resistance of coatings applied at varying temperatures from 90° F. to 150° F. Gluconic acid was present in each solution at a concentration of $0.5 \times 10^{-3}$ moles/liter, and each solution was adjusted to a pH of 3.8 by the addition of concentrated nitric acid. Two cans were employed in determining the water stain resistance rating of each solution.

TABLE III

Effect of $(NH_4)_2ZrF_6$ Concentration on Water Stain Resistance at $0.5 \times 10^{-3}$M Gluconic Acid Concentration and pH of 3.8

| Sample No. | $(NH_4)_2ZrF_6$ Conc. | Temp. (°F.) | Water Stain Resistance |
|---|---|---|---|
| 1 | 0 | 90 | 0,0 |
| 2 | 0 | 110 | 0,0 |
| 3 | 0 | 130 | 0,0 |
| 4 | 0 | 150 | 0,0 |
| 5 | 0.1 | 90 | 0,0 |
| 6 | 0.1 | 110 | 0,0 |
| 7 | 0.1 | 130 | 0,0 |
| 8 | 0.1 | 150 | 0,0 |
| 9 | 0.25 | 90 | 0,0 |
| 10 | 0.25 | 110 | 0,0 |
| 11 | 0.25 | 130 | 3,3 |
| 12 | 0.25 | 150 | 3,3 |
| 13 | 0.50 | 90 | 0,0 |
| 14 | 0.50 | 110 | 2,2 |
| 15 | 0.50 | 130 | 3,3 |
| 16 | 0.50 | 150 | 4,4 |
| 17 | 0.75 | 90 | 2,2 |
| 18 | 0.75 | 110 | 2,2 |
| 19 | 0.75 | 130 | 3,3 |
| 20 | 0.75 | 150 | 4,4 |
| 21 | 1.25 | 90 | 1,1 |
| 22 | 1.25 | 110 | 2,2 |
| 23 | 1.25 | 130 | 3,3 |
| 24 | 1.25 | 150 | 4,4 |
| 25 | 1.75 | 90 | 1,1 |
| 26 | 1.75 | 110 | 2,2 |
| 27 | 1.75 | 130 | 4,4 |
| 28 | 1.75 | 150 | 5,5 |
| 29 | 2.25 | 90 | 1,1 |
| 30 | 2.25 | 110 | 2,2 |
| 31 | 2.25 | 130 | 4,4 |
| 32 | 2.25 | 150 | 5,5 |
| 33 | 5.0 | 90 | 2,2 |
| 34 | 5.0 | 110 | 2,2 |
| 35 | 5.0 | 130 | 4,4 |
| 36 | 5.0 | 150 | 4,4 |

Table IV below shows the effect of ammonium fluozirconate concentration on water stain resistance, as well as on the adhesion of waterborne siccative coatings, at three different pH and two different temperature levels. Again gluconic acid was present in each solution at a concentration of $0.5 \times 10^{-3}$ moles/liter, and the pH of each solution was adjusted by the addition of concentrated nitric acid. Two cans were employed in determining the paint adhesion rating while the water stain resistance rating represents the average of six cans.

TABLE IV

Effect of $(NH_4)_2ZrF_6$ Concentration on Water Stain Resistance and Adhesion of Waterborne Siccative Coatings at $0.5 \times 10^{-3}$ M Gluconic Acid Concentration

| Sample No. | $(NH_4)_2ZrF_6$ Conc. ($M \times 10^{-3}$) | pH | Temp. (°F.) | Water Stain Resistance | Adhesion CE3179-2 | Adhesion S145-121 |
|---|---|---|---|---|---|---|
| 1 | 0.75 | 3.5 | 125 | 4⅜ | 10,8 | 10,10 |
| 2 | 0.75 | 3.5 | 135 | 5 | 10,10 | 10,10 |
| 3 | 0.75 | 4.0 | 125 | 4-5/6 | 9,9 | 10,10 |
| 4 | 0.75 | 4.0 | 135 | 4⅜ | 10,8 | 10,10 |
| 5 | 0.75 | 4.25 | 125 | 4 | 10,10 | 10,8 |
| 6 | 0.75 | 4.25 | 135 | 4 | 10,8 | 9,9 |
| 7 | 1.25 | 3.5 | 125 | 5 | 10,10 | 10,10 |
| 8 | 1.25 | 3.5 | 135 | 5 | 10,10 | 10,10 |
| 9 | 1.25 | 4.0 | 125 | 5 | 10,10 | 10,10 |
| 10 | 1.25 | 4.0 | 135 | 5 | 10,8 | 10,9 |
| 11 | 1.25 | 4.25 | 125 | 4⅜ | 10,10 | 10,10 |
| 12 | 1.25 | 4.25 | 135 | 4⅛ | 10,9 | 10,10 |
| 13 | 1.75 | 3.5 | 125 | 4 | 10,10 | 10,8 |
| 14 | 1.75 | 3.5 | 135 | 4 | 10,8 | 9,9 |
| 15 | 1.75 | 4.0 | 125 | 4 | 10,10 | 10,10 |
| 16 | 1.75 | 4.0 | 135 | 4 | 10,10 | 10,10 |
| 17 | 1.75 | 4.25 | 125 | 4 | 10,10 | 10,10 |
| 18 | 1.75 | 4.25 | 135 | 4 | 10,10 | 10,10 |
| 19 | Cleaned Only | | | 0 | 10,9 | 10,10 |

Table V below illustrates the water stain resistance of coatings formed from a solution of hafnium tetrafluoride, hydrofluoric acid and gluconic acid at varying temperatures from 90° F. to 150° F. The solution contained $1.25 \times 10^{-3}$ moles/liter of hafnium tetrafluoride, $2.5 \times 10^{-3}$ moles/liter of hydrofluoric acid and $0.5 \times 10^{-3}$ moles/liter of gluconic acid. For comparative purposes, coatings was also formed from a like solution free of gluconic acid. The pH of both solutions were adjusted to 3.8 by the addition of concentrated nitric acid. Two cans were employed in determining the water stain resistance rating of the solutions.

TABLE V

Water Stain Resistance of Coatings Formed From a Solution of Hafnium Tetrafluoride, Hydrofluoric Acid and Gluconic Acid

| Sample No. | $HfF_4$ ($M \times 10^{-3}$) | HF ($M \times 10^{-3}$) | Gluconic Acid ($M \times 10^{-3}$) | pH | Temp. (°F.) | Water Stain Resistance |
|---|---|---|---|---|---|---|
| 1 | 1.25 | 2.5 | 0 | 3.8 | 90 | 0 |
| 2 | 1.25 | 2.5 | 0 | 3.8 | 110 | 1 |
| 3 | 1.25 | 2.5 | 0 | 3.8 | 130 | 1 |
| 4 | 1.25 | 2.5 | 0 | 3.8 | 150 | 2 |
| 5 | 1.25 | 2.5 | 0.5 | 3.8 | 90 | 1 |
| 6 | 1.25 | 2.5 | 0.5 | 3.8 | 110 | 1 |
| 7 | 1.25 | 2.5 | 0.5 | 3.8 | 130 | 5 |
| 8 | 1.25 | 2.5 | 0.5 | 3.8 | 150 | 5 |

Tables VI, VII, VIII and IX illustrate the effect of pH and temperature on the water stain resistance of coatings formed from a solution of ammonium fluozirconate and gluconic acid, as well as on the adhesion of waterborne siccative coatings to such coatings. The solution employed contained $1.25 \times 10^{-3}$ moles/liter of the ammonium fluozirconate and $0.5 \times 10^{-3}$ moles/liter of the gluconic acid. For comparative purposes, coatings were also formed from a like solution free of gluconic acid. The pH of both solutions were adjusted to the values shown in the tables by the addition of concentrated nitric acid. Such solutions were than applied at varying temperatures from 90° F. to 160° F. Two cans were employed in determining the water stain resistance rating and one can was employed in determining the paint adhesion rating at each pH and temperature value. The condition of each solution (clear or cloudy) at each pH and temperature level employed is also set forth. As can be seen from the tables, the presence of gluconic acid is important at pH of 4.5 and 5.0 in maintaining a clear solution and preventing precipitation.

TABLE VI

Effect of Temperature on Water Stain Resistance of Coatings Formed From a Solution of $1.25 \times 10^{-3}$M $(NH_4)_2ZrF_6$ and $0.5 \times 10^{-3}$M Gluconic Acid at a pH of 3.0, and on the Adhesion of Waterborne Siccative Coatings to Such Coatings

| Sample No. | Gluconic Acid Conc. ($M \times 10^{-3}$) | Temp. (°F.) | Water Stain Resistance | Adhesion CE3179-2 | Solution Condition |
|---|---|---|---|---|---|
| 1 | 0 | 90 | 2,2 | 10 | Clear |
| 2 | 0 | 100 | 2,2 | 10 | Clear |
| 3 | 0 | 110 | 1,1 | 10 | Clear |
| 4 | 0 | 120 | 1,1 | 10 | Clear |
| 5 | 0 | 130 | 1,1 | 10 | Clear |
| 6 | 0 | 140 | 2,2 | 10 | Clear |
| 7 | 0 | 150 | 3,3 | 10 | Clear |
| 8 | 0 | 160 | 3,3 | 10 | Clear |
| 9 | 0.5 | 90 | 3,3 | 10 | Clear |
| 10 | 0.5 | 100 | 3,3 | 10 | Clear |
| 11 | 0.5 | 110 | 3,3 | 10 | Clear |
| 12 | 0.5 | 120 | 4,4 | 10 | Clear |
| 13 | 0.5 | 130 | 4,4 | 10 | Clear |
| 14 | 0.5 | 140 | 5,5 | 10 | Clear |
| 15 | 0.5 | 150 | 5,5 | — | Clear |
| 16 | 0.5 | 160 | 5,5 | 7 (heavy paint) | Clear |

TABLE VII

Effect of Temperature on Water Stain Resistance of Coatings Formed From a Solution of $1.25 \times 10^{-3}$ M $(NH_4)_2ZrF_6$ and $0.5 \times 10^{-3}$ M Gluconic Acid at a pH of 3.5, and on the Adhesion of Waterborne Siccative Coatings to Such Coatings

| Sample No. | Gluconic Acid Conc. ($M \times 10^{-3}$) | Temp. (°F.) | Water Stain Resistance | Adhesion CE3179-2 | Solution Condition |
|---|---|---|---|---|---|
| 1 | 0 | 90 | 0,0 | 10 | Clear |
| 2 | 0 | 100 | 0,0 | 10 | Clear |
| 3 | 0 | 110 | 0,0 | 10 | Clear |
| 4 | 0 | 120 | 0,0 | 10 | Clear |
| 5 | 0 | 130 | 1,1 | 10 | Clear |
| 6 | 0 | 140 | 2,3 | 10 | Clear |
| 7 | 0 | 150 | 2,3 | 10 | Clear |
| 8 | 0 | 160 | 2,3 | 10 | Clear |
| 9 | 0.5 | 90 | 2,2 | 10 | Clear |
| 10 | 0.5 | 100 | 2,2 | 10 | Clear |
| 11 | 0.5 | 110 | 3,3 | 10 | Clear |
| 12 | 0.5 | 120 | 3,4 | 10 | Clear |
| 13 | 0.5 | 130 | 4,4 | 10 | Clear |
| 14 | 0.5 | 140 | 5,5 | 10 | Clear |
| 15 | 0.5 | 150 | 5,5 | 10 | Clear |
| 16 | 0.5 | 160 | 5,5 | 10 | Clear |

TABLE VIII

Effect of Temperature on Water Stain Resistance of Coatings Formed From a Solution of $1.25 \times 10^{-3}$M $(NH_4)_2ZrF_6$ and $0.5 \times 10^{-3}$M Gluconic Acid at a pH of 4.5, and on the Adhesion of Waterborne Siccative Coatings to Such Coatings

| Sample No. | Gluconic Acid Conc. ($M \times 10^{-3}$) | Temp. (°F.) | Water Stain Resistance | Adhesion CE3179-2 | Solution Condition |
|---|---|---|---|---|---|
| 1 | 0 | 90 | 0,0 | 10 | Clear |
| 2 | 0 | 100 | 0,0 | 10 | Slight Haze |
| 3 | 0 | 110 | 0,0 | 10 | Faint Haze |
| 4 | 0 | 120 | 3,1 | 10 | Cloudy |
| 5 | 0 | 130 | 2,1 | 10 | Cloudy |
| 6 | 0 | 140 | 2,2 | 10 | Cloudy |
| 7 | 0 | 150 | 2,2 | 10 | Cloudy |
| 8 | 0 | 160 | 2,3 | 10 | Very Cloudy |
| 9 | 0.5 | 90 | 0,0 | 10 | Clear |
| 10 | 0.5 | 100 | 0,1 | 10 | Clear |

TABLE VIII-continued

Effect of Temperature on Water Stain Resistance of Coatings Formed From a Solution of $1.25 \times 10^{-3}$M $(NH_4)_2ZrF_6$ and $0.5 \times 10^{-3}$M Gluconic Acid at a pH of 4.5, and on the Adhesion of Waterborne Siccative Coatings to Such Coatings

| Sample No. | Gluconic Acid Conc. ($M \times 10^{-3}$) | Temp. (°F.) | Water Stain Resistance | Adhesion CE3179-2 | Solution Condition |
|---|---|---|---|---|---|
| 11 | 0.5 | 110 | 2,1 | 10 | Clear |
| 12 | 0.5 | 120 | 3,1 | 10 | Clear |
| 13 | 0.5 | 130 | 4,4 | 10 | Clear |
| 14 | 0.5 | 140 | 4,4 | 10 | Clear |
| 15 | 0.5 | 150 | 4,4 | 10 | Clear |
| 16 | 0.5 | 160 | 4,4 | 10 | Clear |

TABLE IX

Effect of Temperature on Water Stain Resistance of Coatings Formed From a Solution of $1.25 \times 10^{-3}$M $(NH_4)_2ZrF_6$ and $0.5 \times 10^{-3}$M Gluconic Acid at a pH of 5.0, and on the Adhesion of Waterborne Siccative Coatings to Such Coatings

| Sample No. | Gluconic Acid Conc. ($M \times 10^{-3}$) | Temp. (°F.) | Water Stain Resistance | Adhesion Ce3179-2 | Solution Condition |
|---|---|---|---|---|---|
| 1 | 0 | 90 | 2,2 | 10 | Cloudy |
| 2 | 0 | 100 | 2,2 | 10 | Cloudy |
| 3 | 0 | 110 | 3,3 | 10 | Cloudy |
| 4 | 0 | 120 | 4,3 | 10 | Cloudy |
| 5 | 0 | 130 | 4,3 | 10 | Cloudy |
| 6 | 0 | 160 | 4,3 | 10 | Cloudy |
| 7 | 0.5 | 90 | 3,2 | 10 | Clear |
| 8 | 0.5 | 100 | 3,3 | 10 | Clear |
| 9 | 0.5 | 110 | 3,3 | 10 | Clear |
| 10 | 0.5 | 120 | 4,3 | 10 | Clear |
| 11 | 0.5 | 130 | 4,3 | 10 | Clear |
| 12 | 0.5 | 140 | 4,3 | 10 | Clear |
| 13 | 0.5 | 150 | 4,3 | 10 | Clear |
| 14 | 0.5 | 160 | 4,2 | 10 | Clear initially cloudy after standing for ~1 hr. |

Table X below shows how the addition of phosphate to ammonium fluozirconate solution adversely affects the adhesion of waterborne siccative coatings to coatings formed from such solutions. The concentration of phosphate and ammonium fluozirconate in each of the solutions prepared is shown in the table. The phosphate was added as phosphoric acid. The pH of the solutions varied as shown in the table. Again nitric acid was employed to adjust the pH. The solutions were applied at a temperature of 130° F. Two cans were employed in determining each paint adhesion rating of each solution.

TABLE X

Effect of Phosphate Concentration on Adhesion of Waterborne Siccative Coatings to Coatings Formed From Fluozirconate Solutions

| Sample No. | $(NH_4)_2ZeF_6$ ($M \times 10^{-3}$) | Phosphate ($M \times 10^{-3}$) | pH | Adhesion CE179-2 | Adhesion S145-121 |
|---|---|---|---|---|---|
| 1 | 0.5 | 0 | 3.5 | 10,9 | 9,6 |
| 2 | 0.5 | 0 | 4.0 | 10,10 | 8,7 |
| 3 | 0.5 | 0.1 | 3.5 | 10,5 | 8,6 |
| 4 | 0.5 | 0.1 | 4.0 | 10,5 | 7,0 |
| 5 | 0.5 | 0.25 | 3.5 | 0,0 | 9,6 |
| 6 | 0.5 | 0.25 | 4.0 | 0,0 | 8,7 |
| 7 | 1.25 | 0 | 3.5 | 10,10 | 9,6 |
| 8 | 1.25 | 0 | 4.0 | 10,9 | 8,7 |
| 9 | 1.25 | 0.1 | 3.5 | 7,0 | 8,7 |
| 10 | 1.25 | 0.1 | 4.0 | 6,5 | 10,0 |
| 11 | 1.25 | 0.25 | 3.5 | 0,0 | 7,7 |
| 12 | 1.25 | 0.25 | 4.0 | 0,0 | 8,0 |
| 13 | 2.5 | 0 | 3.5 | 10,10 | 10,8 |
| 14 | 2.5 | 0 | 4.5 | 10,9 | 9,6 |
| 15 | 2.5 | 0.1 | 3.5 | 0,0 | 10,9 |
| 16 | 2.5 | 0.1 | 4.0 | 9,8 | 8,8 |
| 17 | 2.5 | 0.25 | 3.5 | 7,5 | 8,5 |
| 18 | 2.5 | 0.25 | 4.0 | 0,0 | 9,5 |
| 19 | Cleaned Only | | | 10,10 | 10,8 |

Table XI below shows how the addition of phosphate and gluconic acid to ammonium fluozirconate solutions affects the adhesion of waterborne siccative coatings to coatings formed from such solutions. The concentration of each of these materials in each of the solutions prepared is shown in the table. The phosphate was added as phosphoric acid. The pH of the solutions varied as shown in the table and again concentrated nitric acid was employed to adjust the pH. The solutions were applied at the temperatures indicated. Two cans were employed in determining each paint adhesion rating of each solution.

TABLE XI

Effect of Phosphate and Gluconic Acid Concentration on Adhesion of Waterborne Siccative Coatings to Coatings Formed from Fluozirconate Solutions

| Sample No. | $(NH_4)_2ZrF_6$ ($M \times 10^{-3}$) | Phosphate ($M \times 10^{-3}$) | Gluconic Acid ($M \times 10^{-3}$) | pH | Temp. (°F.) | Adhesion CE3179-2 | Adhesion S145-121 |
|---|---|---|---|---|---|---|---|
| 1 | 0.25 | 0 | 0 | 4.0 | 110 | 10,10 | 10,8 |
| 2 | 0.25 | 0 | 0 | 4.0 | 130 | 10,10 | 8,8 |
| 3 | 0.25 | 0.1 | 0 | 4.0 | 110 | 10,8 | 10,10 |
| 4 | 0.25 | 0.1 | 0 | 4.0 | 130 | 7,7 | 10,8 |
| 5 | 0.25 | 0 | 0.5 | 4.0 | 110 | 10,10 | 10,10 |
| 6 | 0.25 | 0 | 0.5 | 4.0 | 130 | 10,10 | 10,10 |
| 7 | 0.25 | 0.1 | 0.5 | 4.0 | 110 | 8,6 | 10,10 |
| 8 | 0.25 | 0.1 | 0.5 | 4.0 | 130 | 0,0 | 10,7 |
| 9 | 0.25 | 0 | 0 | 3.5 | 110 | 10,10 | 10,10 |
| 10 | 0.25 | 0 | 0 | 3.5 | 130 | 10,10 | 10,10 |
| 11 | 0.25 | 0.1 | 0 | 3.5 | 110 | 5,5 | 10,7 |
| 12 | 0.25 | 0.1 | 0 | 3.5 | 130 | 0,5 | 0,0 |
| 13 | 0.25 | 0 | 0.5 | 3.5 | 110 | 10,10 | 10,10 |
| 14 | 0.25 | 0 | 0.5 | 3.5 | 130 | 10,10 | 10,10 |
| 15 | 0.25 | 0.1 | 0.5 | 3.5 | 110 | 10,7 | 7,6 |
| 16 | 0.25 | 0.1 | 0.5 | 3.5 | 130 | 7,7 | 7,7 |
| 17 | 1.25 | 0 | 0 | 3.5 | 110 | 10,10 | 10,7 |
| 18 | 1.25 | 0 | 0 | 3.5 | 130 | 10,10 | 9,7 |
| 19 | 1.25 | 0.1 | 0 | 3.5 | 110 | 10,10 | 10,10 |
| 20 | 1.25 | 0.1 | 0 | 3.5 | 130 | 0,0 | 7,5 |
| 21 | 1.25 | 0 | 0.5 | 3.5 | 110 | 10,10 | 10,8 |
| 22 | 1.25 | 0 | 0.5 | 3.5 | 130 | 10,8 | 10,8 |
| 23 | 1.25 | 0.1 | 0.5 | 3.5 | 110 | 10,7 | 5,5 |
| 24 | 1.25 | 0.1 | 0.5 | 3.5 | 130 | 10,8 | 7,0 |

TABLE XI-continued

Effect of Phosphate and Gluconic Acid Concentration on Adhesion of Waterborne Siccative Coatings to Coatings Formed from Fluozirconate Solutions

| Sample No. | $(NH_4)_2ZrF_6$ ($M \times 10^{-3}$) | Phosphate ($M \times 10^{-3}$) | Gluconic Acid ($M \times 10^{-3}$) | pH | Temp. (°F.) | Adhesion CE3179-2 | Adhesion S145-121 |
|---|---|---|---|---|---|---|---|
| 25 | Cleaned Only | | | | | 10,10 | 10,10 |

In order to demonstrate that aluminum surfaces coated with a coating solution containing gluconic acid, zirconium and fluoride undergo the so-called "muffle test", while aluminum surfaces coated with a like coating solution free of gluconic acid do not, a number of aluminum cans were coated with solutions having the compositions shown in Table XII below. The coated cans were then heated at a temperature of 900° F. for 5 minutes and the color of the cans was observed. The results observed are set forth in the table. The solutions employed all had a pH of 4.25, obtained by the addition of concentrated nitric acid, and were applied at the temperatures shown in the table.

TABLE XII

Muffle Test Results of Coated Aluminum Surfaces

| Sample No. | $(NH_4)_2ZrF_6$ ($M \times 10^{-3}$) | Gluconic Acid ($M \times 10^{-3}$) | Temp. (°F.) | Surface Color After Heating at 900° F. for 5 Minutes |
|---|---|---|---|---|
| 1 | 1.25 | 0 | 125 | Silver |
| 2 | 1.25 | 0 | 135 | Silver |
| 3 | 1.25 | 0.5 | 125 | light golden brown |
| 4 | 1.25 | 0.5 | 135 | light golden brown |
| 4 | Cleaned Only | | | Silver |

What is claimed is:

1. An aluminum surface having a uniformly colorless and clear coating which is free of boron and phosphate and is capable of turning light golden brown to purple in color when heated at a temperature of 900° F. for 5 minutes, but which resists blackening for at least 5 minutes when heated in water having a temperature within the range of about 140° F. to about 170° F., said coated aluminum surface having been obtained by contacting such aluminum surface with an acidic aqueous coating solution having a pH within the range of about 3.0 to about 5.0 and consisting essentially of at least about $0.5 \times 10^{-3}$ moles/liter of zirconium or hafnium or a mixture thereof, at least about $0.025 \times 10^{-3}$ moles/liter of a polyhydroxy compound having no more than 7 carbon atoms, and at least sufficient fluoride to combine with and form a soluble complex with all of the zirconium and hafnium present in the solution, wherein said polyhydroxy compound is selected from the group consisting of gluconic acid, a salt of gluconic acid, sorbitol, mannitol, dextrose, ethylene glycol, glycerine, and glucoheptonate.

2. An aluminum surface as in claim 1 wherein zirconium is present in the coating solution employed to coat the surface.

3. An aluminum surface as in claim 2 wherein the coating solution employed to coat the surface has a pH of about 3.0 to about 4.0.

4. An aluminum surface as in claim 1, 2 or 3 wherein nitric acid is present in the coating solution employed to coat the surface.

5. An aluminum surface as in claim 2 wherein the source of zirconium is ammonium fluozirconate.

6. An aluminum surface as in claim 5 wherein the coating solution employed to coat the surface has a pH of about 3.0 to about 4.0.

7. An aluminum surface as in claim 5 or 6 wherein nitric acid is present in the coating solution employed to coat the surface.

8. An aluminum surface as in claim 2 wherein the source of zirconium is fluozirconic acid.

9. An aluminum surface as in claim 8 wherein the coating solution employed to coat the surface has a pH of about 3.0 to about 4.0.

10. An aluminum surface as in claim 8 or 9 wherein nitric acid is present in the coating solution employed to coat the surface.

11. An aluminum surface as in claim 2 wherein the polyhydroxy compound is selected from the group consisting of gluconic acid and salts of gluconic acid.

12. An aluminum surface as in claim 11 wherein the coating solution employed to coat the surface has a pH of about 3.0 to about 4.0.

13. An aluminum surface as in claim 11 or 12 wherein nitric acid is present in the coating solution employed to coat the surface.

14. An aluminum surface as in claim 5 wherein the polyhydroxy compound is selected from the group consisting of gluconic acid and salts of gluconic acid.

15. An aluminum surface as in claim 14 wherein the coating solution employed to coat the surface has a pH of about 3.0 to about 4.0.

16. An aluminum surface as in claim 14 or 15 wherein nitric acid is present in the coating solution employed to coat the surface.

17. An aluminum surface as in claim 8 wherein the polyhydroxy compound is selected from the group consisting of gluconic acid and salts of gluconic acid.

18. An aluminum surface as in claim 17 wherein the coating solution employed to coat the surface has a pH of about 3.0 to about 4.0.

19. An aluminum surface as in claim 17 or 18 wherein nitric acid is present in the coating solution employed to coat the surface.

20. An aluminum surface as in claim 2, 5 or 8 wherein the coating solution employed to coat the surface contains from about $0.5 \times 10^{-3}$ moles/liter to about $1.75 \times 10^{-3}$ moles/liter of zirconium and from about $0.3 \times 10^{-3}$ moles/liter to about $1.75 \times 10^{-3}$ moles/liter of polyhydroxy compound.

21. An aluminum surface as in claim 20 wherein the coating solution employed to coat the surface has a pH of about 3.0 to about 4.0.

22. An aluminum surface as in claim 20 wherein nitric acid is present in the coating solution employed to coat the surface.

23. An aluminum surface as in claim 20 wherein nitric acid is present in the coating solution employed to coat the surface and the solution has a pH of about 3.0 to about 4.0.

24. An aluminum surface as in claim 11, 14 or 17 wherein the coating solution employed to coat the surface contains from about $0.5 \times 10^{-3}$ moles/liter to about $1.75 \times 10^{-3}$ moles/liter of zirconium and from about $0.3 \times 10^{-3}$ moles/liter to about $1.75 \times 10^{-3}$ moles/liter of polyhydroxy compound.

25. An aluminum surface as in claim 24 wherein the coating solution employed to coat the surface has a pH of about 3.0 to about 4.0.

26. An aluminum surface as in claim 24 wherein nitric acid is present in the coating solution employed to coat the surface.

27. An aluminum surface as in claim 24 wherein nitric acid is present in the coating solution employed to coat the surface and the solution has a pH of about 3.0 to about 4.0.

28. A continuous process for coating aluminum surfaces having a bright shiny appearance which comprises contacting such surfaces with an acidic aqueous coating solution having a pH within the range of about 3.0 to about 5.0 and consisting essentially of at least about $0.5\times10^{-3}$ moles/liter of zirconium or hafnium or a mixture thereof, at least about $0.025\times10^{-3}$ moles/liter of a polyhydroxy compound having no more than 7 carbon atoms, and sufficient fluoride to combine with and form a soluble complex with all of the zirconium and hafnium present in the solution and provide uncomplexed available fluoride, said solution being free of boron and phosphate, and replenishing said solution as necessary with aqueous replenishing concentrate so as to maintain such concentrations, said replenishing concentrate also being free of boron and phosphate, so as to continuously produce aluminum surfaces having uniformly colorless and clear coatings which are capable of turning light golden brown to purple in color when heated at a temperature of 900° F. for 5 minutes, but which resist blackening for at least 5 minutes when heated in water having a temperature within the range of about 140° F. to about 170° F., wherein said polyhydroxy compound is selected from the group consisting of gluconic acid, a salt of gluconic acid, sorbitol, mannitol, dextrose, ethylene glycol, glycerine and glucoheptonate.

29. A process as in claim 28 wherein zirconium is present in the coating solution employed to coat the surfaces and the temperature of the coating solution is at least about 110° F. to about 160° F.

30. An aluminum surface as in claim 29 wherein the coating solution employed to coat the surfaces has a pH of about 3.0 to about 4.0.

31. A process as in claim 28, 29 or 30 wherein nitric acid is present in the coating solution employed to coat the surfaces.

32. A process as in claim 29 wherein the source of zirconium is ammonium fluozirconate.

33. A process as in claim 32 wherein the coating solution employed to coat the surfaces has a pH of about 3.0 to about 4.0.

34. A process as in claim 32 or 33 wherein nitric acid is present in the coating solution employed to coat the surfaces.

35. A process as in claim 29 wherein the source of zirconium is fluozirconic acid.

36. A process as in claim 35 wherein the coating solution employed to coat the surfaces has a pH of about 3.0 to about 4.0.

37. A process as in claim 35 or 36 wherein nitric acid is present in the coating solution employed to coat the surfaces.

38. A process as in claim 29 wherein the polyhydroxy compound is selected from the group consisting of gluconic acid and salts of gluconic acid.

39. A process as in claim 38 wherein the coating solution employed to coat the surfaces has a pH of about 3.0 to about 4.0.

40. A process as in claim 38 or 39 wherein nitric acid is present in the coating solution employed to coat the surfaces.

41. A process as in claim 32 wherein the polyhydroxy compound is selected from the group consisting of gluconic acid and salts of gluconic acid.

42. A process as in claim 41 wherein the coating solution employed to coat the surfaces has a pH of about 3.0 to about 4.0.

43. A process as in claim 41 or 42 wherein nitric acid is present in the coating solution employed to coat the surfaces.

44. A process as in claim 35 wherein the polyhydroxy compound is selected from the group consisting of gluconic acid and salts of gluconic acid.

45. A process as in claim 44 wherein the coating solution employed to coat the surfaces has a pH of about 3.0 to about 4.0.

46. A process as in claim 44 or 45 wherein nitric acid is present in the coating solution employed to coat the surfaces.

47. A process as in claim 29, 32 or 35 wherein the coating solution employed to coat the surfaces has a temperature of from about 130° F. to about 150° F. and contains from about $0.5\times10^{-3}$ moles/liter to about $1.75\times10^{-3}$ moles/liter of zirconium and from about $0.3\times10^{-3}$ moles/liter to about $1.75\times10^{-3}$ moles/liter of polyhydroxy compound, and the replenishing concentrate consists essentially of from about $30.8\times10^{-3}$ moles/liter to about $250.5\times10^{-3}$ moles/liter of zirconium, from about $18.9\times10^{-3}$ moles/liter to about $148.0\times10^{-3}$ moles/liter of polyhydroxy compound, and a material which is a source of about $89.5\times10^{-3}$ moles/liter to about $695.0\times10^{-3}$ moles/liter of uncomplexed available fluoride.

48. A process as in claim 47 wherein the coating solution employed to coat the surfaces has a pH of about 3.0 to about 4.0.

49. A process as in claim 47 wherein nitric acid is present in the coating solution employed to coat the surfaces.

50. A process as in claim 47 wherein nitric acid is present in the coating solution employed to coat the surfaces and the solution has a pH of about 3.0 to about 4.0.

51. A process as in claim 38, 41 or 44 wherein the coating solution employed to coat the surfaces has a temperature of from about 130° F. to about 150° F. and contains from about $0.5\times10^{-3}$ moles/liter to about $1.75\times10^{-3}$ moles/liter of zirconium and from about $0.3\times10^{-3}$ moles/liter to about $1.75\times10^{-3}$ moles/liter of polyhydroxy compound, and the replenishing concentrate consists essentially of from about $30.8\times10^{-3}$ moles/liter to about $250.5\times10^{-3}$ moles/liter of zirconium, from about $18.9\times10^{-3}$ moles/liter to about $148.0\times10^{-3}$ moles/liter of polyhydroxy compound, and a material which is a source of about $89.5\times10^{-3}$ moles/liter to about $695.0\times10^{-3}$ moles/liter of uncomplexed available fluoride.

52. A process as in claim 51 wherein the coating solution employed to coat the surfaces has a pH of about 3.0 to about 4.0.

53. A process as in claim 51 wherein nitric acid is present in the coating solution employed to coat the surfaces.

54. A process as in claim 51 wherein nitric acid is present in the coating solution employed to coat the surfaces and the solution has a pH of about 3.0 to about 4.0.

55. A acidic aqueous coating solution having a pH within the range of about 3.0 to about 5.0 and consisting essentially of at least about $0.5\times10^{-3}$ moles/liter of zirconium or hafnium or a mixture thereof, at least about $0.025\times10^{-3}$ moles/liter of polyhydroxy compound having no more than 7 carbon atoms, and at least sufficient fluoride to combine with and form a soluble complex with all of the zirconium and hafnium present in the solution, said solution being free of boron and phosphate and capable of forming a uniformly colorless and clear coating on an aluminum surface which is capable of turning light golden brown to purple in color when heated at a temperature of 900° F. for about 5 minutes, but which resists blackening for at least 5 minutes when heated in water having a temperature within the range of about 140° F. to about 170° F., wherein said polyhydroxy compound is selected from the group consisting of gluconic acid, a salt of gluconic acid, sorbitol, mannitol, dextrose, ethylene glycol, glycerine, and glucoheptonate.

56. An aqueous concentrate such that an aqueous coating solution containing about 0.5 to about 10 weight percent of the concentrate has a pH within the range of about 3.0 to about 5.0 and consists essentially of at least about $0.5\times10^{-3}$ moles/liter of zirconium or hafnium or a mixture thereof, at least about $0.025\times10^{-3}$ moles/liter of a polyhydroxy compound having no more than 7 carbon atoms, and at least sufficient fluoride to combine with and form a soluble complex with all of the zirconium and hafnium present in the solution, said coating solution being free of boron and phosphate and capable of forming a uniformly colorless and clear coating on a aluminum surface which is capable of turning light golden brown to purple in color when heated at a temperature of 900° F. for 5 minutes, but which resists blackening for at least 5 minutes when heated in water having a temperature within the range of about 140° F. to about 170° F., wherein said polyhydroxy compound is selected from the group consisting of gluconic acid, a salt of gluconic acid, sorbitol, mannitol, dextrose, ethylene glycol, glycerine, and glucoheptonate.

57. An aluminum surface having a uniformly colorless and clear coating which is free of boron and phosphate and is capable of turning light golden brown to purple in color when heated at a temperature of 900° F. for 5 minutes, but which resists blackening for at least 5 minutes when heated in water having a temperature within the range of about 140° F. to about 170° F., said coated aluminum surface having been obtained by contacting such aluminum surface with an acidic aqueous coating solution having a pH within the range of about 3.0 to about 5.0 and consisting essentially of at least about $0.5\times10^{-3}$ moles/liter of zirconium or hafnium or a mixture thereof, at least about $0.025\times10^{-3}$ moles/liter of a water soluble polyhydroxy compound having no more than 7 carbon atoms, and at least sufficient fluoride to combine with and form a soluble complex with all of the zirconium and hafnium present in the solution.

58. A continuous process for coating aluminum surfaces having a bright shiny appearance which comprises contacting such surfaces with an acidic aqueous coating solution having a pH within the range of about 3.0 to about 5.0 and consisting essentially of at least about $0.5\times10^{-3}$ moles/liter of zirconium or hafnium or a mixture thereof, at least about $0.025\times10^{-3}$ moles/liter of a water soluble polyhydroxy compound having no more than 7 carbon atoms, and sufficient fluoride to combine with and form a soluble complex with all of the zirconium and hafnium present in the solution and provide uncomplexed available fluoride, said solution being free of boron and phosphate, and replenishing said solution as necessary with aqueous replenishing concentrate so as to maintain such concentrations, said replenishing concentrate also being free of boron and phosphate, so as to continuously produce aluminum surfaces having uniformly colorless and clear coatings which are capable of turning light golden brown to purple in color when heated at a temperature of 900° F. for 5 minutes, but which resist blackening for at least 5 minutes when heated in water having a temperature within the range of about 140° F. to about 170° F.

59. An acidic aqueous coating solution having a pH within the range of about 3.0 to about 5.0 and consisting essentially of at least about $0.5\times10^{-3}$ moles/liter of zirconium and hafnium or a mixture thereof, at least about $0.025\times10^{-3}$ moles/liter of a water soluble polyhydroxy compound having no more than 7 carbon atoms, and at least sufficient fluoride to combine with and form a soluble complex with all of the zirconium and hafnium present in the solution, said solution being free of boron and phosphate and capable of forming a uniformly colorless and clear coating on an aluminum surface which is capable of turning light golden brown to purple in color when heated at a temperature of 900° F. for about 5 minutes, but which resists blackening for at least 5 minutes when heated in water having a temperature within the range of about 140° F. to about 170° F.

60. An aqueous concentrate such that an aqueous coating solution containing about 0.5 to about 10 weight percent of the concentrate has a pH within the range of about 3.0 to about 5.0 and consists essentially of at least about $0.5\times10^{-3}$ moles/liter of zirconium or hafnium or a mixture thereof, at least about $0.025\times10^{-3}$ moles/liter of a water soluble polyhydroxy compound having no more than 7 carbon atoms, and at least sufficient fluoride to combine with and form a soluble complex with all of the zirconium and hafnium present in the solution, said coating solution being free of boron and phosphate and capable of forming a uniformly colorless and clear coating on an aluminum surface which is capable of turning light golden brown to purple in color when heated at a temperature of 900° F. for 5 minutes, but which resists blackening for at least 5 minutes when heated in water having a temperature within the range of about 140° F. to about 170° F.

61. An aluminum surface as in claim 1 or 57 wherein said coating underlies an overlying water-borne coating.

62. A process as in claim 28 or 58 including applying to said coating an overlying water-borne coating.

63. An aluminum surface as in claim 61 wherein said water-borne coating is a polyester coating.

64. A process as in claim 62 wherein said water-borne coating is a polyester coating.

* * * * *

UNITED STATES PATENT AND TRADEMARK OFFICE

CERTIFICATE OF CORRECTION

PATENT NO. : 4,273,592

DATED : June 16, 1981

INVENTOR(S) : Timm L. Kelly

It is certified that error appears in the above—identified patent and that said Letters Patent is hereby corrected as shown below:

| | |
|---|---|
| Col. 2, line 53 | "3,610,506" should read --3,160,506--. |
| Col. 6, line 36 | "$10^{-5}$" should read --$10^{-3}$--. |
| Col. 21, line 43 | "An aluminum surface" should read --A process--. |

Signed and Sealed this

Ninth Day of March 1982

[SEAL]

Attest:

GERALD J. MOSSINGHOFF

Attesting Officer

Commissioner of Patents and Trademarks